US005975375A

United States Patent [19]

Renault et al.

[11] Patent Number: 5,975,375

[45] Date of Patent: Nov. 2, 1999

[54] PIVOT-TYPE PUMP HAVING FLEXIBLE LIQUID SUPPLY ROD AND METHOD

[75] Inventors: Philippe Renault, Paris, France; Pedro Pares Montaner, Barcelone, Spain

[73] Assignee: L'Oreal, Paris, France

[21] Appl. No.: 08/664,197

[22] Filed: Jun. 10, 1996

[30] Foreign Application Priority Data

Jun. 8, 1995 [FR] France ..... 95 06762

[51] Int. Cl.[6] ..... B65D 83/14

[52] U.S. Cl. ..... 222/321.8

[58] Field of Search ..... 222/321.8, 321.9, 222/382, 383.1, 402.13, 402.21, 402.23, 341, 385

[56] References Cited

U.S. PATENT DOCUMENTS

| | | | |
|---|---|---|---|
| 3,107,826 | 10/1963 | Kruck | 222/402.13 |
| 3,887,115 | 6/1975 | Petterson | 222/402.13 |
| 5,423,460 | 6/1995 | Thomann | 222/383.1 |

FOREIGN PATENT DOCUMENTS

| | | | |
|---|---|---|---|
| 385077 | 9/1990 | European Pat. Off. | 222/321.8 |
| 2 682 937 | 4/1993 | France . | |
| 2 715 585 | 8/1995 | France . | |
| 2261618 | 5/1993 | United Kingdom . | |

*Primary Examiner*—Philippe Derakshani
*Attorney, Agent, or Firm*—Oliff & Berridge, PLC

[57] ABSTRACT

A pumping device for removing liquid from a container and dispensing it in the form of a spray includes a pump attached to the upper end of a container. A pump body is engaged in the container and a piston is movable in the container and is provided with a hollow rod projecting outside of the pump. A cylindrical cap is attachable to the container and has a pivoting actuating and dispensing element provided with a dispensing nozzle communicating through a passage with a cylindrical sheath projecting inside the actuating element. The free end of the hollow rod of the pump piston engages the sheath, and the hollow rod is flexible over part of its length as measured from its free end.

10 Claims, 2 Drawing Sheets

PIVOT-TYPE PUMP HAVING FLEXIBLE LIQUID SUPPLY ROD AND METHOD

BACKGROUND OF THE INVENTION

The present invention relates to a pump device and method for removing a liquid from a container and dispensing it in the form of a spray.

More specifically, the present invention relates to a device of the type having a pump attached to the upper end of the container. The pump includes a pump body disposed in the container and a piston is movable in the pump body and provided with a hollow rod projecting outside of the pump. A cylindrical cap is attachable to the container and has a pivotable actuating and dispensing element provided with a dispensing nozzle communicating via a passage with a cylindrical sheath projecting inside the actuating element. The free end of the hollow rod of the pump piston engages the cylindrical sheath.

The actuating element includes at a first end a lever and at a second end a spray nozzle. The actuating element is articulated to the cap, the cap being hollowed to provide access to the opposite end of the lever-shaped actuating element, the first end also providing a bearing area for the user's finger. When the user presses down, the actuating element pivots, exerting a downward force on the hollow rod of the piston engaged by its free end in the internal cylindrical sheath of the actuating element.

The hollow rod constitutes means or structure by which the pumped liquid passes from the container to the dispensing nozzle of the cap. The axial movement of the hollow rod of the piston must be substantially if not fully linear, also keeping in mind that sufficient rigidity on the rod must be maintained to prevent any buckling as the rod moves when the actuating element pivots.

A number of solutions have been proposed to take into account off-center forces applied to the rigid hollow rod of the pump piston as a result of the pivoting movement of the actuating element.

For example, FR-A-2,682,937 proposes to connect the end of the hollow piston rod to the cylindrical sheath of the actuating element by a tubular element with flexible links. This solution requires separate fabrication of an additional built-on part to link the hollow piston rod to the actuating and dispensing element.

Also, the assignee of the present invention has proposed (in French Patent Application No. 94 00988) to manufacture the cylindrical sheath of the actuating and dispensing element in the form of a relatively long flexible passage. In practice, however, the cap and the actuating element provided with the cylindrical sheath and made in one piece therewith must be made of a relatively rigid material, such as polypropylene or high-density polyethylene. Indeed, the cap must be sufficiently rigid so that, on the one hand, it can be snapped onto the container body and, on the other hand, can ensure that the hinge area providing the articulated link of the actuating element to the cap wall is sufficiently strong to allow a large number of actuations, and finally to ensure that the lever-shaped actuating element is sufficiently rigid over its entire length.

If a rigid material is used to make an assembly including the cap and actuating element, the cylindrical sheath of the actuating element, to be sufficiently flexible, must have a very thin wall, which entails the risk of flexural breakage when the actuating element pivots.

The device known from the French patent application referred to above is possible, in practice, only with pumps such as those described in this document, requiring only a short length of travel of the hollow rod of the pump piston, and is accordingly limited in application.

SUMMARY OF THE INVENTION

One object of the present invention proposes to make a device that in particular avoids the above-identified drawbacks of the known devices.

According to one aspect of the present invention, the hollow rod of the pump piston is flexible over part of its length from its free end. Advantageously, the flexibility may be conferred by decreasing the wall thickness of the rod in the direction of its free end. The rod is preferably made, particularly by injection, of a flexible material such as low-density polyethylene.

The rod can have a reduced thickness only in its end area designed to engage the cylindrical sheath of the actuating element or over a greater length, in particular, the length of the rod projecting from the upper end of the pump in the resting position of the actuating element. The length of the cylindrical sheath is preferably substantially less than the length of the part of the rod projecting from the pump. The wall thickness of the sheath may be, however, greater than the wall thickness of the rod at its free end engaged in the sheath. Advantageously, according to the invention, the pump may have along its upper part an internal cylindrical skirt having an extension guiding the hollow piston rod.

According to a another aspect of the present invention, there is provided a pumping device for transporting liquid from a container and dispensing the liquid through a nozzle. The pumping device comprises a pump attached to an upper end of the container, the pump including a pump body engaged in the container, a piston movable in the pump body and provided with a hollow rod having a free end projecting outside the pump; and a cylindrical cap attachable to the container and having a pivotable actuating and dispensing element provided with the nozzle, the nozzle communicating through a passage with a cylindrical sheath projecting from the actuating element, the sheath being dimensioned to receive the free end of the hollow rod, wherein the hollow rod is flexible over at least a portion in a vicinity of the free end.

According to still another aspect of the present invention, there is provided a device for dispensing liquid through a nozzle comprising a liquid fillable container, a pump attached to the container, the pump including a reciprocating piston provided with a hollow rod having a free end projecting outside the pump, a pivotable actuating and dispensing element provided to cause liquid to be dispensed through the nozzle, and a cylindrical sheath projecting from the actuating element, the sheath being dimensioned to engage the free end of the hollow rod, wherein the hollow rod has a variable rigidity along a length of the rod toward the sheath.

According to yet another aspect of the present invention, there is provided a method for dispensing liquid through a nozzle of a liquid fillable container. The method comprises applying a force causing rotating of a pivotable actuating and dispensing element, reciprocating a piston provided with a hollow rod having a free end projecting outside the pump, the applying and reciprocating enabling liquid flow from the container through the pump to the nozzle; and adjustably flexing the rod in a region approaching the free end of the hollow rod connected to the actuating element.

The device according to the invention can be used by any type of pump that has a hollow rod projecting from the pump body, regardless of the piston travel length. The device according to the invention is particularly suitable for pre-compression pumps, namely of the type having, in the pump body, an internal compression chamber wherein liquid coming from the container and introduced under the influence of the suction produced by piston actuation is expelled into the hollow piston rod when a preset pressure is reached inside the chamber. For this purpose, the chamber communicates with the lower end of the passage of the hollow rod of the piston with interposition of a check valve set by a spring to open at the preset pressure.

These and other salient features of the invention will be described in or apparent from the following description of preferred embodiments.

BRIEF DESCRIPTION OF THE DRAWINGS

For better understanding of the present invention, one embodiment thereof, which is not limiting, will now be described with reference to the attached drawings wherein.

DETAILED DESCRIPTION OF PREFERRED EMBODIMENTS

Figure 1:
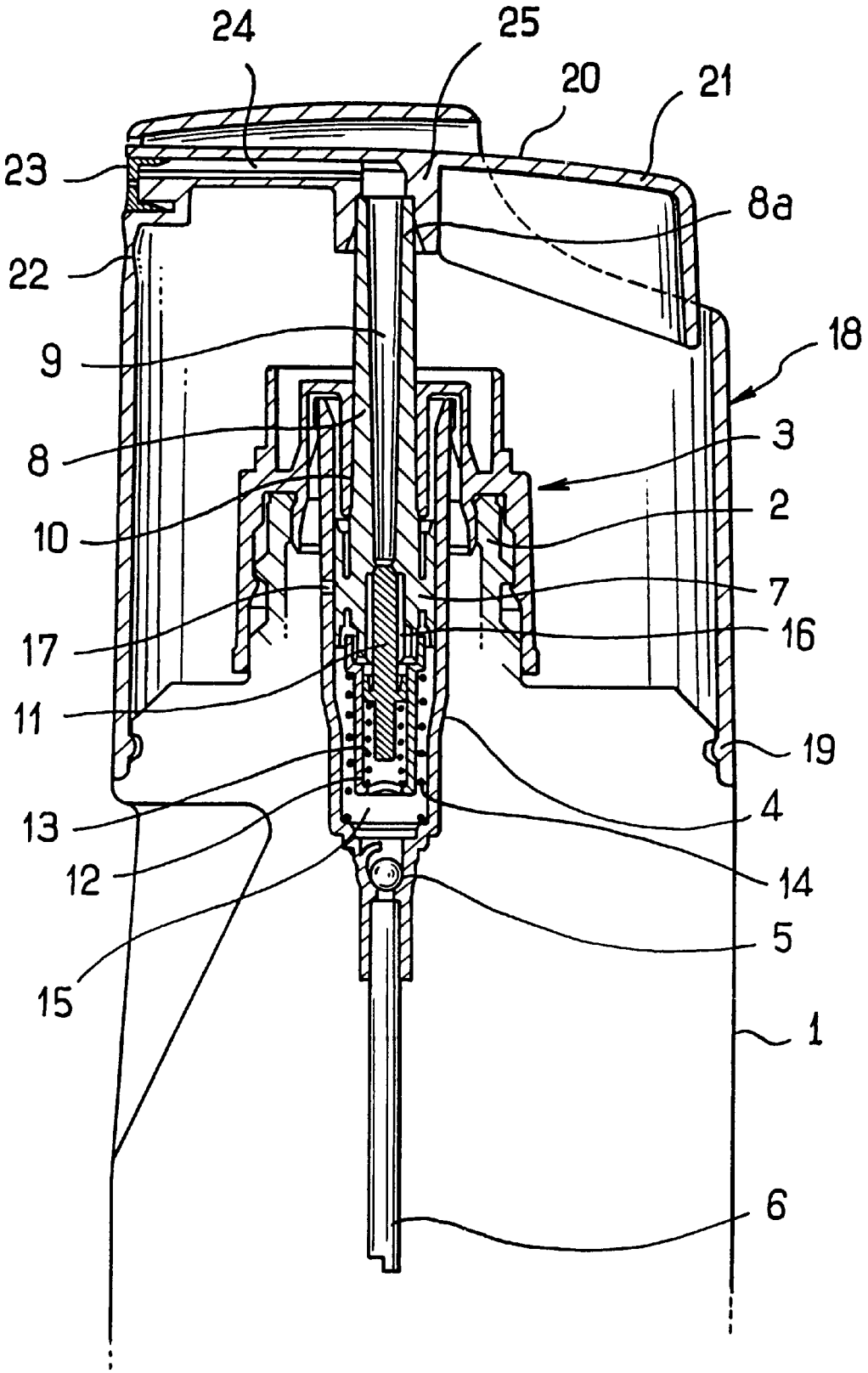
FIGS. 1 and 2 are cross-sectional views of the upper end of a container provided with a device according to the present invention, in two positions, respectively, during operation.

FIG. 1 illustrates the upper part of a container 1 having a neck 2 and being fillable with a liquid to be dispensed in the form of a spray, such as a hair lacquer.

The container is non-pressurized, hence containing no propellant gas, and the liquid is expelled by actuation of a pump 3 mounted on the neck 2 of the container. The pump 3 has a tubular pump body 4 provided, in the vicinity of its lower end, with a ball valve 5, with the liquid reaching the pump body through a tube 6 immersed in the liquid.

Figure 2:
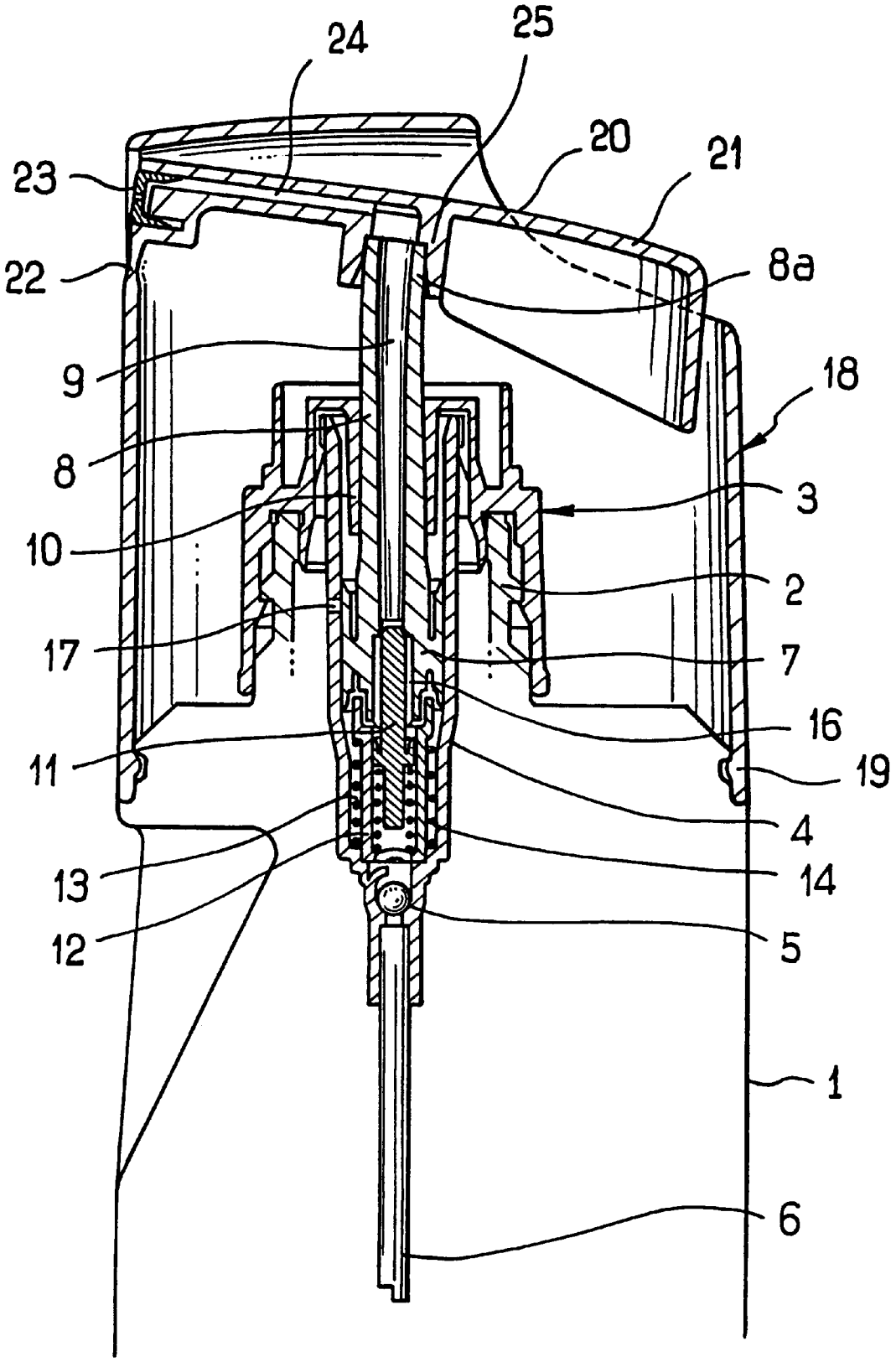

A piston 7 provided with peripheral sealing lips is mounted inside the pump body 4 in order to slide along the inside wall thereof. The piston 7 is hollow and has a hollow piston rod 8 defining an axial passage 9. As can be seen in FIGS. 1 and 2, the hollow rod 8 projects beyond the upper end of the pump 3. The pump 3 has at its upper part, for guidance of the rod 8, an internal cylindrical skirt 10.

According to the invention, a wall of the hollow rod 8 has a reduced thickness at least in its free or distal end 8*a*. In the example illustrated, the wall of the hollow rod 8 has a section that gradually decreases over the major part of its length up to the free end.

The lower end of the passage 9 of the hollow rod 8 is blocked by a check valve made in the form of an elongate pin 11 provided with a peripheral extension comprising a sealing lip, the pin being displaceable in a tubular part 12 against a return spring 13 abutting the bottom of the tubular part 12 and a peripheral extension of the pin 11. The tubular part 12 is moveable, with the piston 7 against a return spring 14 that abuts a lower part of the pump body 4 and a shoulder of the tubular part 12. Such an arrangement defines a pumping chamber 15 at the lower part of the pump body 4 and a compression chamber 16 between the pin 11 and the piston 7. An orifice 17 provided in the wall of the pump body 4 allows compression chamber 16 to be pressurized when the piston 7 is actuated by pressing the piston rod 8.

Once the pressure prevailing in compression chamber 16 reaches a value allowing the force of spring 13 to be overcome, the pin 11 descends, thus placing the chamber 16 in communication with the passage 9 of the hollow rod 8 and allowing expulsion of the liquid in the chamber 16, which comes from the pumping chamber 15, which is supplied with liquid via a tube 6 by suction created when the piston 7 is urged upwardly by the return spring 14. The pump illustrated is thus of the pre-compression type and has a comparable structure and operation to those described in the above-referenced French Patent Application No. 94 00988 of the present assignee.

The device according to the invention has a cylindrical cap 18 attached at its lower part, particularly by a snap connection as illustrated at 19, to the upper part of container 1. The cap has a one piece lever-shaped actuating element 20 that has a rear part forming a support area 21 accessible through a hollowed part of the cap. The actuating element 20 is articulated at its front part to the cap wall by a reduced-thickness area forming a hinge 22. Above the hinge 22, the actuating element 20 has a dispensing nozzle 23 at the end of a passage 24 communicating with an inner space of a cylindrical sheath 25 that projects downward from the lower surface of actuating element 20. A free end 8*a* of the hollow rod 8 of piston 7 is engaged in the cylindrical sheath 25, which is shorter in length than the length of the rod 8 projecting from pump 3.

It will be understood that the liquid expelled by the passage 9 of rod 8 can travel through actuating element 20 up to dispensing nozzle 23 thereof where it is sprayed in the form of fine droplets.

The assembly comprised of the cap 18 and the actuating element 20 is made of a relatively rigid material such as high-density polyethylene while the piston 7 and the piston rod 8 are made of a more flexible material, for example, low-density polyethylene. Due to the difference in materials, and particularly due to the reduction in thickness of the piston, for example, in the region of rod 8, the free end 8*a*, when the actuating element 20 is actuated, the rod 8 undergoes buckling over a portion of its height, starting at the end 8*a*, but the travel of the piston rod 8 inside the pump remains axial and rectilinear, particularly due to the additional guidance provided by skirt 10.

Although the invention has been described in connection with a particular embodiment, it is obvious that it is not limited thereto and that a number of variants and modifications could be made thereto without thereby departing either from its framework or its spirit as defined in the appended claims.

What is claimed is:

1. A pumping device for transporting liquid from a container and dispensing the liquid through a nozzle, said pumping device comprising:

a pump attached to an upper end of the container, said pump including a pump body engaged in the container;

a piston movable in the pump body and provided with a one-piece hollow rod having a free end projecting outside the pump; and a cylindrical cap attachable to the container and having a pivotable actuating and dispensing element provided with said nozzle, said nozzle communicating through a passage with a cylindrical sheath projecting from said actuating element, said sheath being dimensioned to receive the free end of the one-piece hollow rod, wherein said one-piece hollow rod is flexible over at least a portion in a vicinity of the free end.

2. The pumping device according to claim 1, wherein a length of the cylindrical sheath projecting from an inside wall of the actuating element is less than a length of said rod projecting from the pump.

3. The pumping device according to claim 1, wherein a wall thickness of said sheath is greater than a wall thickness of said free end.

4. The pumping device according to claim 1, wherein the pump has an upper part including an inner cylindrical skirt providing an extension guiding the hollow rod of the piston.

5. The pumping device according to claim 1, wherein the piston and the hollow piston rod are made of a low-density polyethylene material that is less rigid than a second material of which the cap and the actuating element are made, said second material being one of polypropylene and high-density polyethylene.

6. A device for dispensing liquid through a nozzle, said device comprising:

a liquid fillable container;

a pump attached to the container, said pump including a reciprocating piston provided with a hollow rod having a free end projecting outside the pump;

a pivotable actuating and dispensing element provided to cause liquid to be dispensed through the nozzle; and a cylindrical sheath projecting from said actuating element, said sheath being dimensioned to engage the free end of the hollow rod, wherein said hollow rod has a variable rigidity along a length of the hollow rod toward the sheath.

7. The device according to claim 6, wherein the container includes a cap having a wall member defining an integrally formed pivot for said actuating element.

8. A method for dispensing liquid through a nozzle of a liquid fillable container, said method comprising:

applying a force causing rotating of a pivotable actuating and dispensing element;

reciprocating a piston provided with a one-piece hollow rod having a free end projecting outside a pump, said applying and reciprocating enabling liquid flow from said container through said pump to said nozzle; and adjustably flexing the one-piece hollow rod in a region approaching the free end of the one-piece hollow rod connected to the actuating element.

9. A pumping device for transporting liquid from a container and dispensing the liquid through a nozzle, said pumping device comprising:

a pump attached to an upper end of the container, said pump including a pump body engaged in the container;

a piston movable in the pump body and provided with a hollow rod having a free end projecting outside the pump; and a cylindrical cap attachable to the container and having a pivotable actuating and dispensing element provided with said nozzle, said nozzle communicating through a passage with a cylindrical sheath projecting from said actuating element, said sheath being dimensioned to receive the free end of the hollow rod, wherein said hollow rod is flexible over at least a portion in a vicinity of the free end, wherein a wall thickness of said rod decreases toward the free end.

10. A device for dispensing liquid through a nozzle, said device comprising:

a liquid fillable container;

a pump attached to the container, said pump including a reciprocating piston provided with a hollow rod having a free end projecting outside the pump;

a pivotable actuating and dispensing element provided to cause liquid to be dispensed through the nozzle; and a cylindrical sheath projecting from said actuating element, said sheath being dimensioned to engage the free end of the hollow rod, wherein said hollow rod has a variable rigidity along a length of the hollow rod towards the sheath, wherein the hollow rod has a tapered profile narrowing toward said free end.

* * * * *